US007039202B1

(12) United States Patent
Takeuchi

(10) Patent No.: US 7,039,202 B1
(45) Date of Patent: May 2, 2006

(54) MICROPHONE UNIT

(75) Inventor: Takanobu Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 839 days.

(21) Appl. No.: 09/620,595

(22) Filed: Jul. 20, 2000

(30) Foreign Application Priority Data

Feb. 15, 2000 (JP) ..... 2000-036326

(51) Int. Cl.
*H04R 3/00* (2006.01)

(52) U.S. Cl. ..... 381/113; 330/303

(58) Field of Classification Search ..... 381/91–92, 381/174–175, 113, 111–112, 122, 71.6, 191; 307/400; 327/559, 552; 330/303, 288
See application file for complete search history.

(56) References Cited

U.S. PATENT DOCUMENTS

| | | | | |
|---|---|---|---|---|
| 3,116,366 | A * | 12/1963 | Seligson | 381/113 |
| 3,810,032 | A * | 5/1974 | Van der Plaats | 330/254 |
| 4,079,335 | A * | 3/1978 | Doerig | 330/281 |
| 4,255,716 | A * | 3/1981 | Takada | 330/284 |
| 4,361,735 | A | 11/1982 | Johnson et al. | |
| 4,491,972 | A * | 1/1985 | Weber | 455/110 |
| 4,518,829 | A * | 5/1985 | Boeckmann | 379/395 |
| 4,731,849 | A * | 3/1988 | Bloomfield, III | 381/67 |
| 4,951,174 | A | 8/1990 | Grantham et al. | |
| 5,490,220 | A | 2/1996 | Loeppert | |
| 5,675,296 | A * | 10/1997 | Tomikawa | 331/158 |
| 5,767,545 | A | 6/1998 | Takahashi | |
| 6,084,972 | A * | 7/2000 | van Halteren et al. | 381/92 |
| 6,453,048 | B1 * | 9/2002 | Akino | 381/113 |
| 6,516,069 | B1 * | 2/2003 | Takeuchi et al. | 381/122 |
| 6,580,797 | B1 * | 6/2003 | Papadopoulos et al. | 381/111 |
| 6,681,020 | B1 * | 1/2004 | Papopoulos et al. | 381/122 |
| 6,978,029 | B1 * | 12/2005 | Ikeda | 381/111 |
| 2003/0035558 | A1 | 2/2003 | Kawamura et al. | |

FOREIGN PATENT DOCUMENTS

| | | |
|---|---|---|
| DE | 34 13 145 | 10/1985 |
| DE | 689 13 177 | 7/1994 |
| DE | 196 00 689 | 7/1996 |
| DE | 198 39 978 | 3/1999 |
| DE | 197 53 279 | 6/1999 |
| DE | 695 11 207 | 2/2000 |
| WO | WO 94/23547 | 10/1994 |

* cited by examiner

*Primary Examiner*—Huyen Le
*Assistant Examiner*—Lao Lun-See
(74) *Attorney, Agent, or Firm*—Oblon, Spivak, McClelland, Maier & Neustadt, P.C.

(57) ABSTRACT

A microphone unit capable of suppressing the sensitivity reduction due to a parasitic capacitance that occurs depending on the structure of an electret capacitor, can be realized by the following manner. Specifically, an output signal (Vout) that is the inverted output of an input signal (Vin) is inputted to an operational amplifier (OP2) that is an inverting amplifier, such that the output signal (Vout) has the same phase as the input signal (Vin) and is amplified. With an output signal (Vfb) of the operational amplifier (OP2) connected to a first electrode of a parasitic capacitor (CX), the parasitic capacitor (CX) functions as a coupling capacitor, while a feedback is applied to an electret capacitor (EC). This allows for an increase in the voltage between both terminals of the electret capacitor (EC), and thus suppresses that the sensitivity of the microphone unit is lowered due to the parasitic capacitor.

6 Claims, 3 Drawing Sheets

< BACKGROUND ART >

< BACKGROUND ART >

MICROPHONE UNIT

BACKGROUND OF THE INVENTION

1. Field of the Invention

The present invention relates to a microphone unit having an electret capacitor formed in a semiconductor substrate.

2. Description of the Background Art

FIG. 5 shows a circuit diagram of a conventional microphone unit MU2. The microphone unit MU2 has an electret capacitor EC. When the electret capacitor EC receives a sound pressure, its capacitance value varies, and an input signal Vin is generated between both electrodes. Thereby, a voice information is reflected in the input signal Vin. An impedance conversion circuit comprising diodes D1 and D2, resistor R1, and N channel MOS transistors T1 and T2, is connected to both terminals of the electret capacitor EC. Specifically, the anode and cathode of the diode D1 are connected to first and second electrodes of the electret capacitor EC, respectively. The anode and cathode of the diode D2 are connected, in the reverse manner of the diode D1, to both terminals of the electret capacitor EC. The resistor R1 is connected in parallel with both terminals of the electret capacitor EC. The source and gate of the transistor T1 are connected to the second and first electrodes of the electret capacitor EC, respectively. The source of the transistor T2 is connected to the drain of the transistor T1. A power supply potential Vdd and a fixed potential Vref1 are applied to the drain and gate of the transistor T2, respectively. A ground potential GND is applied to each back gate of the transistors T1 and T2. A ground potential GND is also applied to the second electrode of the electret capacitor EC.

When no input signal Vin is applied, the voltage between the gate and source of the transistor T1 is maintained at 0 (V), by the diodes D1 and D2, and the resistor R1. With a sound pressure, the capacitance value of the electret capacitor EC varies, and an input signal Vin is generated, thereby the voltage between the gate and source of the transistor T1 varies. Upon this, the current passing between the drain and source varies. Since the transistor T1 is a depletion type, current passes between the drain and source even when the voltage between the gate and source is 0 (V). Due to variations in the current passing between the drain and source of the transistor T1, the current passing between the drain and source of the transistor T2 varies, and the voltage between the gate and source of the transistor T2 varies accordingly. The potential variation in the source of the transistor T2 generates an output signal Vout. The phase of the output signal Vout is the reverse of that of the input signal Vin. As the value of the input signal Vin decreases, the value of the output signal Vout increases. As the value of the input signal Vin increases, the value of the output signal Vout decreases.

FIG. 6 shows an example of the structure of an electret capacitor EC. The electret capacitor EC has, as a first electrode, a wiring film IL2 disposed above a semiconductor substrate SB. The wiring film IL2 is formed above the semiconductor substrate SB, with insulating films IF1 and IF2 interposed. The electret capacitor EC also has, a second electrode, an electret film EL composed of a dielectric to which a certain amount of electrostatic charge is fixed semipermanently. The electret film EL is disposed above the semiconductor substrate SB and spaced apart from the wiring film IL2. The electret film EL is an oscillating film that oscillates with a sound pressure. In FIG. 6, a ground potential GND is applied to the electret film EL.

The semiconductor substrate SB is, for example, a silicon substrate. In FIG. 6, the semiconductor substrate SB contains, for example, a P type impurity. A ground potential GND is applied to the semiconductor substrate SB. A wiring film IL5 serving as wiring on the circuit is disposed on an insulating film IF1, and an insulating film IF2 is formed so as to cover the insulating film IF1 and the wiring film IL5. The insulating films IF1 and IF2 are, for example, an oxide film or nitride film, and the wiring films 112 and IL5 are, for example, a conductive film composed of Al, or the like. An insulative protecting film PF is formed on the upper surface of the wiring film IL2 and insulating film IF2, so as to cover these films. The protecting film PF is also, for example, an oxide film or nitride film.

The diodes D1 and D2, the resistor R1, and the transistors T1 and T2, which are all shown in FIG. 5, but not shown in FIG. 6, are formed in the vicinity of the electret capacitor EC in the semiconductor substrate SB.

In the electret capacitor EC of the structure shown in FIG. 6, a parasitic capacitance will occur between the semiconductor substrate SB and wiring film IL2, because the wiring film IL2 serving as the second electrode is formed in the surface of the semiconductor substrate SB. In FIG. 5, such a parasitic capacitance is represented by "CX". Since the ground potential GND is applied to the semiconductor substrate SB that is a first electrode of the parasitic capacitor CX, the first electrode of the parasitic capacitor CX has the same potential as the electret film EL. Accordingly, the parasitic capacitor CX is connected in parallel with the electret capacitor EC.

A parasitic capacitor will occur even between the gate and source of the transistor T1. In FIG. 5, such a parasitic capacitor is represented by "CG".

In the absence of the above-mentioned parasitic capacitors CX and CG, the voltage between the gate and source of the transistor T1, i.e., an input signal Vin, is derived as follows:

$$Vin=Q/Ce$$

where Ce is the capacitance value of the electret capacitor EC, and Q is the electric charge amount of a fixed amount of electrostatic charge held by the electret film EL.

For the case of Ce=1.0 (pF), the input signal Vin is $Q/(1.0\times10^{-12})$ (V).

When the existence of parasitic capacitors CX and CG is taken into consideration, the voltage Vin between the gate and source of the transistor T1 is derived as follows:

$$Vin=Q/(Ce+Cx+Cg)$$

where Cx is the capacitance value of the parasitic capacitor CX, and Cg is the capacitance value of a parasitic capacitor CG.

Letting the capacitance value Ce be the same value as described above, and letting the sum of the capacitance values Cx and Cg be Cx+Cg=9.0 (pF), the input signal Vin results in $Q/(10.0\times10^{-12})$ (V). Thus, in the existence of the parasitic capacitors CX and CG, the value of the input signal Vin is one tenth of that in the absence of the parasitic capacitors CX and CG, thereby weakening the signal to be input between the gate and source of the transistor T1.

That is, by the presence of the parasitic capacitors CX and CG, the value of an input signal Vin is reduced and thus less susceptible to variation, thereby lowering the sensitivity of a microphone unit.

SUMMARY OF THE INVENTION

According to a first aspect of the present invention, a microphone unit comprises: an electret capacitor having first and second electrodes; an amplifier with which voltage generated between the first and second electrodes of the electret capacitor is amplified and then outputted; and a capacitor having a first electrode to which the output of the amplifier is applied, and a second electrode connected to the first electrode of the electret capacitor.

In the first aspect, the amplitude of voltage to be generated between the first and second electrodes of the electret capacitor can be increased because an A.C. signal, which is obtained by removing a D.C. bias component from the output of the amplifier with the capacitor, is transmitted to the first electrode of the electret capacitor. This enables to suppress a reduction in the sensitivity of the microphone unit. In addition, by adjusting the capacitance value of the capacitor, the potential in the second electrode of the electret capacitor and the time of potential variation can be adjusted.

Preferably, the amplifier comprises: a first transistor having a first current electrode, a second current electrode connected to the second electrode of the electret capacitor, and a control electrode connected to the first electrode of the electret capacitor; a current source connected to the first current electrode of the first transistor; and an inverting amplifier having an input terminal connected to the first current electrode of the first transistor.

Preferably, the inverting amplifier comprises: a first resistor having a first terminal connected to the first current electrode of the first transistor, and a second terminal; a first operational amplifier having a negative input terminal connected to the second terminal of the first resistor, a positive input terminal to which a first fixed potential is applied, and an output terminal; and a second resistor having a first terminal connected to the negative input terminal of the first operational amplifier, and a second terminal connected to the output terminal of the first operational amplifier.

Preferably, the current source is a second transistor having a first current electrode to which a second fixed potential is applied, a second current electrode connected to the first current electrode of the first transistor, and a control electrode to which a third fixed potential is applied.

Preferably, the amplifier further comprises a voltage follower having an input terminal connected to the first current electrode of the first transistor, and an output terminal connected to the input terminal of the inverting amplifier.

Preferably, the microphone unit further comprises: a first diode having a cathode and an anode connected to the first and second electrodes of the electret capacitor, respectively; a second diode having an anode and a cathode connected to the first and second electrodes of the electret capacitor, respectively; and a third resistor connected in parallel with the electret capacitor.

According to a second aspect, a microphone unit comprises: a semiconductor substrate to which a fixed potential is applied; an insulating layer disposed above the semiconductor substrate; an electret capacitor having a first electrode disposed above the insulating layer, and a second electrode that is free to oscillate and spaced apart from the first electrode; an amplifier with which voltage generated between the first and second electrodes of the electret capacitor is amplified and then outputted; and a conductive layer to which the output of the amplifier is applied, the conductive layer facing the first electrode of the electret capacitor and being disposed below the insulating layer.

In the second aspect, the conductive layer is disposed below the insulating layer so as to face the second electrode of the electret capacitor, and the output of the amplifier is applied to the conductive layer. Therefore, the microphone unit of the first aspect can be realized by that a parasitic capacitance to be generated between the first electrode of the electret capacitor and the conductive layer is used as the capacitor in the microphone unit of the first aspect.

Preferably, the amplifier comprises: a first transistor having a first current electrode, a second current electrode connected to the second electrode of the electret capacitor, and a control electrode connected to the first electrode of the electret capacitor; a current source connected to the first current electrode of the first transistor; and an inverting amplifier having an input terminal connected to the first current electrode of the first transistor.

Preferably, the inverting amplifier comprises: a first resistor having a first terminal connected to the first current electrode of the first transistor, and a second terminal; a first operational amplifier having a negative input terminal connected to the second terminal of the first resistor, a positive input terminal to which a first fixed potential is applied, and an output terminal; and a second resistor having a first terminal connected to the negative input terminal of the first operational amplifier, and a second terminal connected to the output terminal of the first operational amplifier.

Preferably, the current source is a second transistor having a first current electrode to which a second fixed potential is applied, a second current electrode connected to the first current electrode of the first transistor, and a control electrode to which a third fixed potential is applied.

Preferably, the amplifier further comprises a voltage follower having an input terminal connected to the first current electrode of the first transistor, and an output terminal connected to the input terminal of the inverting amplifier.

Preferably, the microphone unit of the second aspect further comprises: a first diode having a cathode and an anode connected to the first and second electrodes of the electret capacitor, respectively; a second diode having an anode and a cathode connected to the first and second electrodes of the electret capacitor, respectively; and a third resistor connected in parallel with the electret capacitor.

According to a third aspect, the microphone unit of the second aspect is characterized in that the conductive layer is an impurity layer formed in the surface of the semiconductor substrate beneath the insulating layer.

In the third aspect, the impurity layer is disposed, as a conductive layer, on the surface of the semiconductor substrate underlying the insulating layer. This facilitates the formation of the conductive layer by means of semiconductor process, such as ion implantation.

According to a fourth aspect, the microphone unit of the third aspect further comprises a wiring layer that is disposed above the insulating layer, and extends through the insulating layer to make contact with the conductive layer.

In the fourth aspect, since the wiring layer is disposed on the insulating layer, the wiring layer and the first electrode of the electret capacitor can be formed at one time in a single step, thus reducing the number of processing steps.

According to a fifth aspect, the microphone unit of the second aspect is characterized in that: the insulating layer has a first insulating film overlying the semiconductor substrate, and a second insulating film overlying the first insulating film; and that the conductive layer is a wiring layer disposed above the first insulating film and below the second insulating film.

In the fifth aspect, the conductive layer overlies the first insulating film and underlies the second insulating film. Therefore, unlike the third aspect, there is no need to dispose an impurity layer on the surface of the semiconductor substrate, thus reducing the number of processing steps. In addition, since the first insulating film is disposed between the conductive layer and the semiconductor substrate, it is relatively less likely to cause a leakage current. The use of a low-resistance material (e.g., Al) as a conductive layer, is effective in preventing an excess power consumption due to the variation in the output of the amplifier.

It is an object of the present invention to provide a microphone unit capable of suppressing the sensitivity reduction due to a parasitic capacitance that occurs depending on the structure of the electret capacitor.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
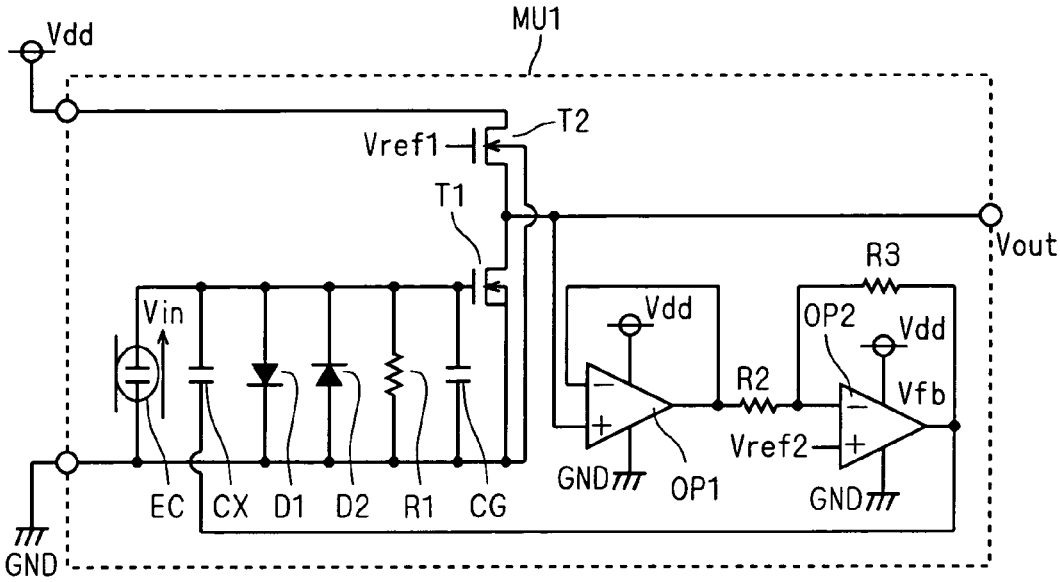
FIG. 1 is a circuit diagram illustrating a microphone unit according to a first preferred embodiment of the invention.

FIG. 1 shows a microphone unit MU1 according to a first preferred embodiment of the invention. Like the microphone unit MU2 shown in FIG. 5, the microphone unit MU1 also has an electret capacitor EC. When the electret capacitor EC receives a sound pressure, its capacitance value varies, and an input signal Vin is generated between both electrodes. The anode and cathode of a diode D1 are connected to first and second electrodes of the electret capacitor EC, respectively. The anode and cathode of a diode D2 are connected, in the reverse manner of the diode D1, in parallel with both terminals of the electret capacitor EC. A resistor R1 is connected in parallel with both terminals of the electret capacitor EC. The source and gate of a transistor T1 are connected to the second and first electrodes of the electret capacitor EC, respectively. The source of a transistor T2 is connected to the drain of the transistor T1. A power supply potential Vdd and a fixed potential Vref1 are applied to the drain and gate of the transistor T2, respectively. A ground potential GND is applied to each back gate of the transistors T1 and T2. A ground potential GND is also applied to the second electrode of the electret capacitor EC. A parasitic capacitor CG is placed between the gate and source of the transistor T1. A parasitic capacitor CX will be described later.

Operation of an impedance conversion circuit comprising the electret capacitor EC, diodes D1 and D2, resistor R1, and transistors T1 and T2, is the same as the microphone unit MU2, and its description is thus omitted herein.

The microphone unit MU1 according to the first preferred embodiment further comprises operational amplifiers OP1 and OP2, and resistors R2 and R3. An output signal Vout at the drain of the transistor T1 is not only outputted as signal, but also inputted to the positive input terminal of the operational amplifier OP1. The output signal of the operational amplifier OP1 is inputted to the negative input terminal of the operational amplifier OP1, which functions as a voltage follower. It should be noted that the voltage follower be provided to take out voltage signals without affecting the circuit on the input side. If an output signal Vout is detectable without affecting the current passing between the drain and source of the transistors T1 and T2, the operational amplifier OP1 may be omitted.

The output signal of the operational amplifier OP1 is inputted via the resistor R2 to the negative input terminal of the operational amplifier OP2. An output signal Vfb of the operational amplifier OP2 is inputted via the resistor R3 to the negative input terminal of the operational amplifier OP2, which functions as an inverting amplifier. A fixed potential Vref2 is applied to the positive input terminal of the operational amplifier OP2.

The inverting amplifier is provided in order that the output signal Vout is fed back to the first electrode of the electret capacitor EC. The output signal Vfb of the operational amplifier OP2 is a feed back signal having the same phase as the input signal Vin, which is generated by inverting and amplifying an output signal Vout. The reason why the output signal Vfb has the same phase as the input signal Vin is that the phase of the output signal Vout is the reverse of that of the input signal Vin, and then is inverted by the operational amplifier OP2. The amplification degree of the output signal Vfb to the input signal Vin is the product of the amplification degree of the output signal Vout in the transistor T1 to the input signal Vin, and the amplification degree of the output signal Vfb in the operational amplifier OP2 to the output signal Vout. Therefore, it can be considered that the inverting amplifier constitutes an amplifier, together with the transistor T1.

Figure 5:
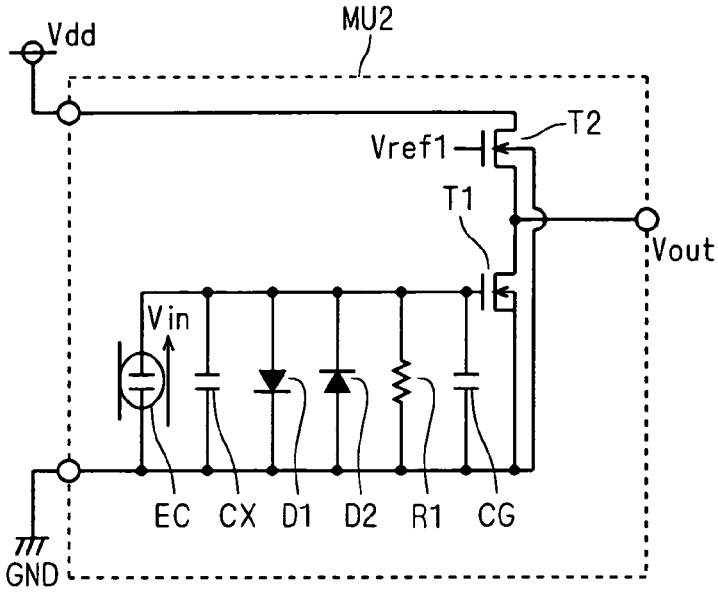
FIG. 5 is a circuit diagram illustrating a conventional microphone unit.

The parasitic capacitor CX will be described hereinbelow. In FIG. 5, the first electrode is the semiconductor substrate SB, and the ground potential GND is applied thereto. Hence, FIG. 5 represents a parallel connection to the electret capacitor EC. Whereas in the first preferred embodiment, instead of a ground potential GND, an output signal Vfb is applied to the first electrode of a parasitic capacitor CX, in order that the output signal Vfb is fed back to the first electrode of the electret capacitor EC. Thus, in the representation of FIG. 1, the parasitic capacitor CX is not connected in parallel with the electret capacitor EC, but the first electrode of the parasitic capacitor CX is connected to the output terminal of the operational amplifier OP2, and its second electrode is connected to the first electrode of the electret capacitor EC.

When an output signal Vfb is applied to the first electrode of the parasitic capacitor CX, the parasitic capacitor CX functions as a coupling capacitor, and removes a D.C. bias component in the output signal Vfb, in order to transmit only an A.C. signal to the first electrode of the electret capacitor EC. Hereat, the value of the A.C. signal transmitted to the first electrode of the electret capacitor EC is amplified by adjusting the amplification degree of the output signal Vfb to the input signal Vin, that is, the amplification degree of voltage signal in each of the transistor T1 and operational amplifier OP2. Thereby, the amplitude value of the voltage between the gate and source of the transistor T1 approaches the value of the input signal Vin in the absence of the parasitic capacitors CX and CG. As stated earlier, since the output signal Vfb is a feed back signal having the same phase as the input signal Vin, the A.C. signal to be transmitted to the first electrode of the electret capacitor EC has also the same phase as the input signal Vin, thereby enhancing the potential variation in the first electrode of the electret capacitor EC. Therefore, the signal between the gate and source of the transistor T1, which has been weakened under the influence of the parasitic capacitors CX and CG, can be amplified to suppress the influence of the parasitic capacitors CX and CG on the microphone unit. That is, when the output signal Vfb that is a feedback signal having the same phase as the input signal Vin is applied to the first electrode of the parasitic capacitor CX, the potential variation in its second electrode is enhanced. This allows for an increase in the voltage between the gate and source of the transistor T1, and thus suppress the sensitivity of the microphone unit MU1 from lowering due to the parasitic capacitor CX.

If the capacitance value of the parasitic capacitor CX is adjustable, it is able to adjust the ratio of the voltage applied to the both terminals of the parasitic capacitor CX to the voltage applied to the electret capacitor EC, which are contained in the output signal Vfb, as well as the time of the potential variation in the first electrode of the electret capacitor EC.

The amplification degree of the voltage signal obtained from both of the transistor T1 and operational amplifier OP2 is preferably adjusted such that the A.C. signal transmitted to the first electrode of the electret capacitor EC does not exceed the value of the input signal Vin in the absence of the parasitic capacitors CX and CG. This is because the A.C. signal having a greater value than the input signal Vin in the absence of the parasitic capacitors CX and CG, results in the positive feedback, and an oscillating phenomenon might occur, failing to function as a microphone unit.

With the microphone unit MU1 of the first preferred embodiment, the A.C. signal which is obtained by removing the D.C. bias component from the output signal Vfb with the parasitic capacitor CX, is transmitted to the first electrode of the electret capacitor EC. It is therefore able to amplify the input signal Vin to be generated between the first and second electrodes of the electret capacitor EC. This allows for an increase in the voltage between the gate and source of the transistor T1, thereby suppressing the sensitivity of the microphone unit MU1 from lowering due to the parasitic capacitor CX. Also, the potential in the first electrode of the electret capacitor EC and the time of the potential variation can be adjusted by controlling the capacitance value of the parasitic capacitor CX.

Although in the first preferred embodiment the MOS transistors are used for the transistors T1 and T2, it is, of course, possible to use bipolar transistors. In that event, the gate, drain and source in the foregoing description should be read base, collector and emitter, respectively.

Second Preferred Embodiment

Figure 2:
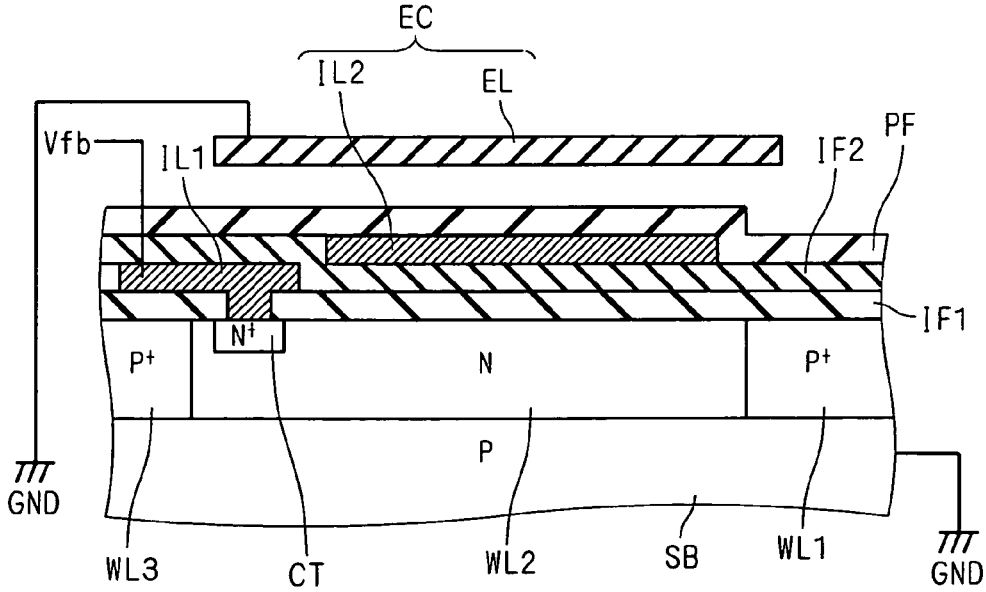
FIG. 2 is a cross section illustrating a microphone unit according to a second preferred embodiment.
Figure 6:
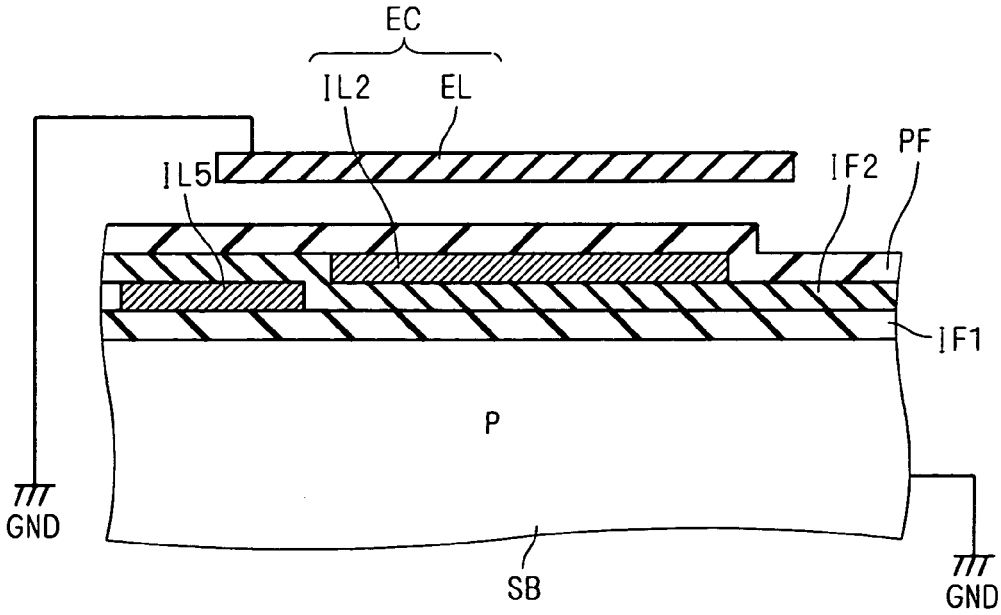
FIG. 6 is a cross section illustrating the conventional microphone unit.

A second preferred embodiment shows an example of the structure in the vicinity of the electret capacitor EC of the microphone unit MU1 according to the first preferred embodiment. FIG. 2 is a cross section of its structure in which an electret capacitor EC has, as a first electrode, a wiring film IL2 disposed above a semiconductor substrate SB, as in FIG. 6. The wiring film IL2 is disposed above the semiconductor substrate SB, with insulating films IF1 and IF2 interposed. The electret capacitor EC also has, a second electrode, an electret film EL composed of a dielectric to which a certain amount of electrostatic charge is fixed semipermanently. The electret film EL is disposed above the semiconductor substrate SB and spaced apart from the wiring film IL2. The electret film EL is an oscillating film that oscillates with a sound pressure. A ground potential GND is applied to the electret film EL.

The semiconductor substrate SB is, for example, a silicon substrate. In FIG. 2, the semiconductor substrate SB contains, for example, a P type impurity. A ground potential GND is applied to the semiconductor substrate SB. Impurity layers WL1 to WL3 are formed in the surface of the semiconductor substrate SB, by means of ion implantation or the like. Specifically, N type impurity layer WL2 is disposed below the wiring film IL2, and P type impurity layers WL1 and WL3 surround the N type impurity layer WL2 for effecting element isolation.

A wiring film IL1 that is the wiring for making connection to the output terminal of an operational amplifier OP2, is disposed on the insulating film IF1. The wiring film IL1 extends through the insulting film IF1 and makes contact with the N type impurity layer WL2 formed in the semiconductor substrate SB. At the contact portion with the wiring film IL1 in the N type impurity layer WL2, a contact region CT having a relatively high impurity concentration is provided for reducing the resistance value in the contact portion.

An insulating film IF2 is formed so as to cover the insulating film IF1 and the wiring film IL1. The insulating films IF1 and IF2 are, for example, an oxide film or nitride film, and the wiring films IL1 and IL2 are, for example, a conductive film composed of Al or the like. An insulative protecting film PF is formed on the upper surface of the wiring film IL2 and insulating film IF2, so as to cover these films. The protecting film PF is also, for example, an oxide film or nitride film.

Further, the diodes D1 and D2, the resistors R1 to R3, the transistors T1 and T2, and operational amplifiers OP1 and OP2, which are all shown in FIG. 1, but not shown in FIG. 2, are formed in the vicinity of the electret capacitor EC in the semiconductor substrate SB.

Thus, in the case where the N type impurity layer WL2 is disposed on the surface of the semiconductor substrate SB, and the output signal Vfb of the operational amplifier OP2 is applied thereto via the wiring film IL2, the parasitic capacitor CX, which has conventionally being caused between the wiring film IL2 and semiconductor substrate SB, will occur between the wiring film IL2 and N type impurity layer WL2. Therefore, like the circuit diagram shown in FIG. 1, the parasitic capacitor CX will be formed between the first electrode of the electret capacitor EC and the output terminal of the operational amplifier OP2.

Since the transistor T1 is a depletion type, an output signal Vout has a positive D.C. bias even in the absence of the input of an input signal Vin. Accordingly, with a suitable setting of a fixed potential Vref2, the output signal Vfb outputted from the operational amplifier OP2 also becomes positive. Upon this, the potential of the N type impurity layer WL2 becomes positive and thus higher than the potential GND of the semiconductor substrate SB. As a result, the reverse bias state of a PN junction is formed between the N type impurity layer WL2 and semiconductor substrate SB, and little or no current flows therebetween.

With the microphone unit of the second preferred embodiment, the N type impurity layer WL2 is formed in the surface of the semiconductor substrate SB, and the output signal Vfb of the operational amplifier OP2 is applied thereto via the wiring film IL2. Therefore, the microphone unit according to the first preferred embodiment can be realized easily by means of semiconductor process, such as ion implantation.

The capacitance value of the parasitic capacitor CX is adjustable by the thickness and dielectric constant of the insulating films IF1 and IF2, and the area of the wiring film IL2 and N type impurity layer W12. Accordingly, as described in the first preferred embodiment, it is able to adjust the ratio of the voltage applied to the both terminals of the parasitic capacitor CX to the voltage applied to the electret capacitor EC, which are contained in the output signal Vfb, as well as the time of the potential variation in the first electrode of the electret capacitor EC.

Third Preferred Embodiment

Figure 3:
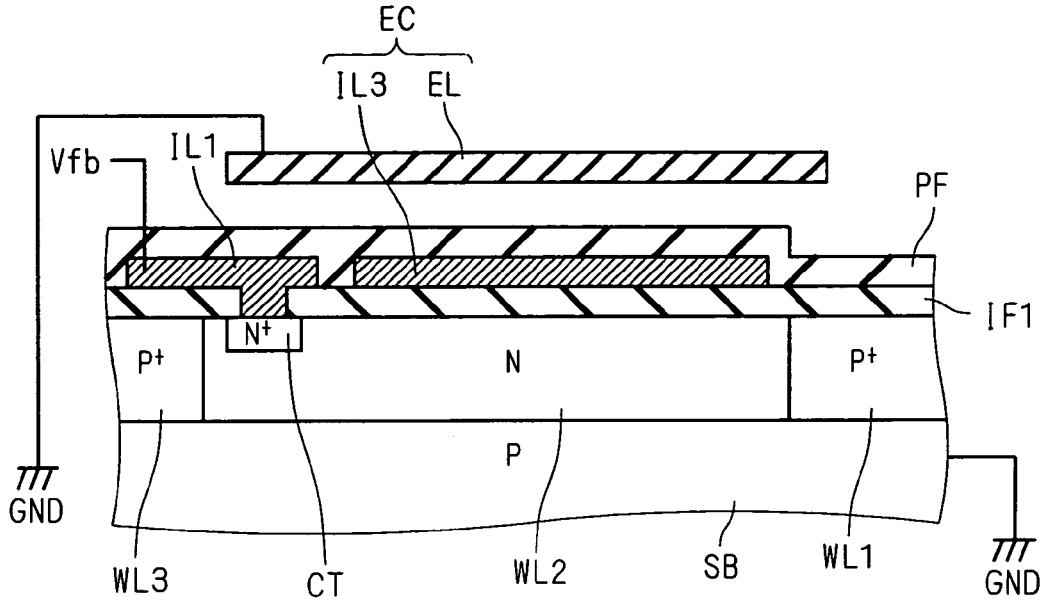
FIG. 3 is a cross section illustrating a microphone unit according to a third preferred embodiment.

A third preferred embodiment is a modification of the microphone unit according to the second preferred embodiment. FIG. 3 is a cross section illustrating its structure. In FIG. 3, components having the same function as in the microphone unit of the second preferred embodiment are identified by the same reference numeral.

In a microphone unit of the third preferred embodiment, no insulating film IF2 is formed, and a wiring film IL3 corresponding to the wiring film IL2 is formed on an insulating film IF1, like a wiring film IL1. By disposing the wiring film IL3 on the insulating film IF1, together with the wiring film IL1, these wiring films can be formed at one time in a single photolithography step in the process of manufacturing a microphone unit, thus reducing the number of processing steps. In addition, the omission of an insulating film IF2 allows for a reduction in the material cost.

Other constructions are common to the second preferred embodiment, and its description is thus omitted herein.

Fourth Preferred Embodiment

Figure 4:
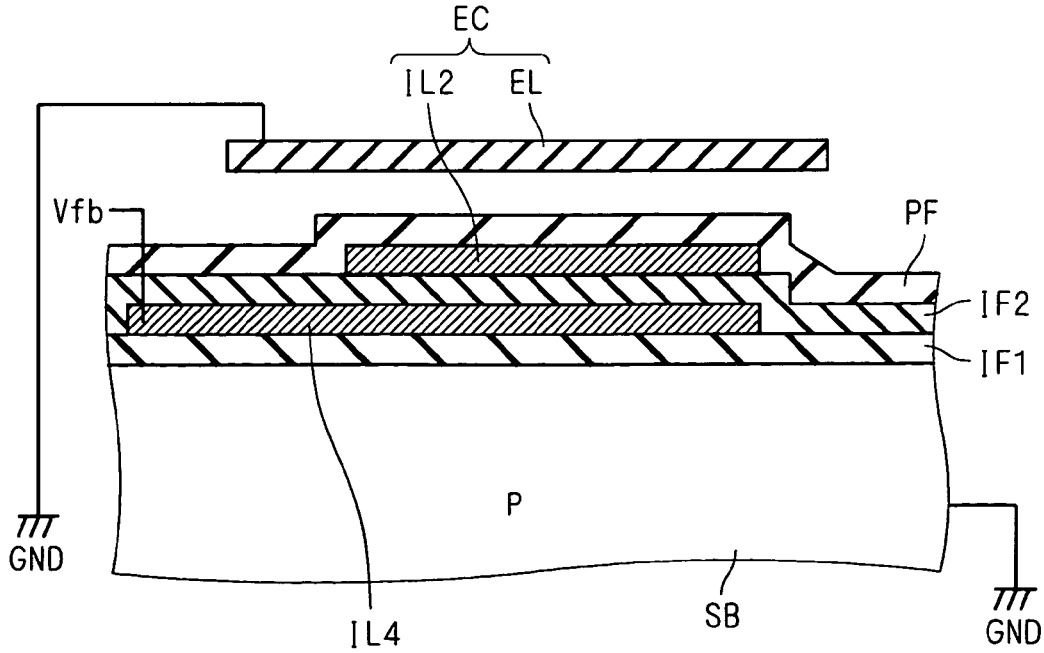
FIG. 4 is a cross section illustrating a microphone unit according to a fourth preferred embodiment.

A fourth preferred embodiment is also a modification of the microphone unit according to the second preferred embodiment. FIG. 4 is a cross section illustrating its structure. In FIG. 4, components having the same function as in the microphone unit of the second preferred embodiment are identified by the same reference numeral.

In a microphone unit of the fourth preferred embodiment, none of impurity layers WL1 to WL3 and a contact region CT are formed, and a wiring film IL4 corresponding to the wiring film IL1 is formed on an insulating film IF1. It should be noted that the wiring film IL4 extends beneath a wiring film IL2, and it also functions as a first electrode of a parasitic capacitor CX, in place of an N type impurity layer WL2.

Thus, by forming the wiring film IL4 so as to extend beneath the wiring film L2, there is no need to form impurity layers WL1 to WL3 and a contact region CT, thereby reducing the number of processing steps.

When the N type impurity layer WL2 is employed as a first electrode of the parasitic capacitor CX, as in the second or third preferred embodiment, it is expected that a leakage current might occur in a semiconductor substrate SB, to make the potential of the N type impurity layer WL2 unstable, alternatively, that an excess power consumption might occur as the output signal Vfb varies, because of a high resistance value of the N type impurity layer WL2.

On the other hand, in the fourth preferred embodiment, when the wiring film IL4 functions as the first electrode of the parasitic capacitor CX, instead of the N type impurity layer WL2, it is relatively less liable to cause a leakage current, because the insulating film IF1 is disposed between the wiring film IL4 and the semiconductor substrate SB. In addition, when a material having a low resistance (e.g., Al) is used as a wiring film IL4, it is less liable to cause an excess power consumption as the output signal Vfb varies.

Other constructions are common to the second preferred embodiment and its description is therefore omitted herein.

While the invention has been shown and described in detail, the foregoing description is in all aspects illustrative and not restrictive. It is therefore understood that numerous modifications and variations can be devised without departing from the scope of the invention.

What is claimed is:

1. A microphone unit comprising:

an electret capacitor having a first electret electrode off ground and a second electret electrode connected to the ground directly;

a transistor amplifier with which voltage generated between said first and second electret electrodes of said electret capacitor is amplified and then outputted to an output of the microphone unit;

at least one operational amplifier connected to the transistor amplifier and receiving the amplified voltage; and an external capacitor having, a first capacitor electrode to which the amplified voltage from said transistor amplifier is applied through the at least one operational amplifier, and a second capacitor electrode connected to said first electret electrode of said electret capacitor off ground.

2. The microphone unit according to claim 1, wherein said transistor amplifier comprises:

a first transistor having a first current electrode, a second current electrode connected to said second electret electrode of said electret capacitor, and a control electrode connected to said first electret electrode of said electret capacitor; and a current source connected to said first current electrode of said first transistor, wherein said at least one operational amplifier comprises an inverting amplifier having an input terminal connected to said first current electrode of said first transistor.

3. The microphone unit according to claim 2, wherein said inverting amplifier comprises:

a first resistor having a first terminal connected to said first current electrode of said first transistor, and a second terminal;

a first operational amplifier having a negative input terminal connected to said second terminal of said first resistor, a positive input terminal to which a first fixed potential is applied, and an output terminal; and a second resistor having a first terminal connected to said negative input terminal of said first operational amplifier, and a second terminal connected to said output terminal of said first operational amplifier.

4. The microphone unit according to claim 2, wherein said current source comprises:

a second transistor having a first current electrode to which a first fixed potential is applied;

a second current electrode connected to said first current electrode of said first transistor; and a control electrode to which a second fixed potential is applied.

5. The microphone unit according to claim 2, said operational amplifier further comprising:

a voltage follower having an input terminal connected to said first current electrode of said first transistor, and an output terminal connected to said input terminal of said inverting amplifier.

6. The microphone unit according to claim 2, further comprising:

a first diode having a cathode and an anode connected to said first and second electret electrodes of said electret capacitor, respectively;

a second diode having an anode and a cathode connected to said first and second electret electrodes of said electret capacitor, respectively; and a third resistor connected in parallel with said electret capacitor.

* * * * *